United States Patent [19]

Goncalves

[11] Patent Number: 4,727,893

[45] Date of Patent: Mar. 1, 1988

[54] DEVICE FOR APPLYING A TREATMENT PRODUCT TO A HEAD OF HAIR, WITH A TRESS BY TRESS APPLICATION PROCEDURE

[75] Inventor: Antonin Goncalves, Groslay, France

[73] Assignee: L'Oreal, Paris, France

[21] Appl. No.: 917,073

[22] Filed: Oct. 8, 1986

[30] Foreign Application Priority Data

Oct. 31, 1985 [FR] France ..... 85 16194

[51] Int. Cl.[4] ..... A45D 24/22

[52] U.S. Cl. ..... 132/88.7; 132/9; 132/116; 132/DIG. 4; 401/265

[58] Field of Search ..... 132/7, 9, 79 A, 79 B, 132/DIG. 3, DIG. 4, 88.5, 11 R, 88.7, 116; 401/265

[56] References Cited

U.S. PATENT DOCUMENTS

| | | | |
|---|---|---|---|
| 1,574,418 | 2/1926 | Coviello | 132/DIG. 3 |
| 1,910,669 | 5/1933 | Biederman | 401/263 |
| 2,819,721 | 1/1958 | Zakon | 132/9 |
| 2,956,570 | 10/1960 | Stanford | 132/DIG. 3 |
| 3,101,086 | 8/1963 | Di Vito | 132/DIG. 3 |
| 3,295,535 | 1/1967 | Amato | 132/9 |
| 3,304,945 | 2/1967 | Anderson | 132/9 |
| 3,468,318 | 9/1969 | Cook et al. | 132/9 |
| 4,209,027 | 6/1980 | Morganroth | 132/9 |
| 4,310,009 | 1/1982 | Shipp | 132/88.7 |
| 4,516,591 | 5/1985 | Hierholzer | 132/DIG. 4 |

FOREIGN PATENT DOCUMENTS

| | | | |
|---|---|---|---|
| 0058321 | 8/1982 | European Pat. Off. | 132/9 |
| 0110277 | 6/1984 | European Pat. Off. . | |
| 8119211 | 7/1981 | Fed. Rep. of Germany . | |
| 3244174 | 5/1984 | Fed. Rep. of Germany | 132/9 |
| 2429038 | 1/1980 | France . | |

*Primary Examiner*—Gene Mancene
*Assistant Examiner*—J. Hakomaki
*Attorney, Agent, or Firm*—Cushman, Darby & Cushman

[57] ABSTRACT

A device for applying a hair treatment product comprises on the one hand a reservoir for the product to be applied and, on the other hand, an applicator end fitting fitted on the outlet opening of the reservoir and comprising at least one outlet opening for the said product and carrying at its free end at least one fork with two prongs which may be guided from one end of a hair tress to the other when the tress is placed between the two prongs of the fork with a view to applying the product over the tress. The space separating the two prongs opens directly at their base into a storage receptacle for the product into which there open or opens the outlet orifice(s) for the said product. This receptacle is delimited on one of its lateral faces by a movable flap which, when in the position freeing the above-mentioned receptacle, permits easy cleaning of the applicator head.

11 Claims, 5 Drawing Figures

DEVICE FOR APPLYING A TREATMENT PRODUCT TO A HEAD OF HAIR, WITH A TRESS BY TRESS APPLICATION PROCEDURE

FIELD OF THE INVENTION

The present invention relates to a device for applying a treatment product, for instance a colouring lotion, to a head of hair using a tress by tress application procedure following a sweeping technique.

PRIOR ART

Several known applicators for tress by tress work comprise a combing device having at least two prongs, the product being transferred to the head of hair by a duct opening in the combing device, either inside one prong as is the case in particular of the applicator in accordance with European Pat. No. 45370 or the applicator in accordance with U.S. Pat. No. 4,495,958, or in the space separating two adjoining prongs, as is the case in the device in accordance with U.S. Pat. No. 4,516,591.

European Patent Application No. 110,277, discloses an applicator device which is formed by two comb prongs joined by a base which is fitted on the dispenser end fitting of a bottle. It appears, however, that this device does not allow easy and rational working, if it is desired to coat the tresses of the head of hair in a regular manner.

Moreover, when proceeding in the conventional way to effect a sweeping action, that is to say, by spreading the product by means of a comb on the tresses, this spreading is only effected in a haphazard way.

OBJECT OF THE INVENTION

It is an object of the present invention to provide a device for applying the treatment product to the tresses of a head of hair in a regular manner, by means of a fork with two prongs allowing a tress of hair to be gripped; with such a device, the product should arrive in the space between the two prongs to enter a receptacle in which the product can be stored before the application; thus a regular distribution of the product is obtained over the tress.

It is a further object of the present invention to provide an applicator which can be easily cleaned inasmuch as it does not comprise relatively small ducts.

It is a further object of the invention to provide an applicator including a receptacle which comprises laterally, a movable flap capable of freeing a lateral opening giving free access to the interior of the receptacle.

SUMMARY OF THE INVENTION

The present invention therefore provides a device for use in applying a treatment product of a liquid or pasty consistency, in particular a tinctorial lotion, to a head of hair proceeding with tress by tress application said device comprising (a) a reservoir for the product to be applied; and (b) an applicator fitting which is fitted on the outlet opening of said reservoir and which comprises at least one outlet orifice for said treatment product and which carries, at its free end, at least one two pronged fork which can be guided from one end of a tress of hair to the other when the tress is placed between the two prongs of the fork for the application of the product to said tress, wherein the space separating the two prongs at their base opens directly in a storage receptacle for the said product, into which there opens the or each outlet orifice for the said product.

In a particular embodiment of the present invention, the receptacle is delimited on the one hand by the walls of a cavity formed in the fixed part of the end fitting, and on the other hand, by a movable part capable of occupying a first end position wherein the said receptacle is constituted with a view to applying the product over a tress of hair, and a second end position, remote from the prongs wherein the said receptacle opens laterally directly below the prongs in a plane parallel to the median plane containing them, to leave a free access to the cavity.

Preferably said movable part is displaceable in translation, in particular in a direction parallel to the longitudinal median line of the space separating the two prongs; the movable part is a flap retractable into the fixed part of the end fitting.

In these conditions, the end fitting may, in particular, comprise, in a plane near that of the access opening to the cavity and at the side of the cavity remote from the prongs, a lateral, substantially flat wall carrying two side wall portions disposed in a plane parallel to said wall, to constitute therewith slides which are directed substantially parallel to the median longitudinal line of the space separating the prongs and which allow the flap to be slidably guided, the flap carrying a handling knob projecting towards the outside.

The fixed and movable parts of the end fitting advantageously comprise complementary means limiting the travel of the movable part in the two directions. Thus means may be provided, carried by the fixed part, for limiting the displacement of the movable part, said limiting means comprising on the one hand, the ends of the slide which curve towards each other at the end remote from the prongs and on the other hand, parts of the side wall portions approaching each other in the region near the lateral opening of the cavity and which constitute stops for projections carried by said movable part.

In accordance with other characteristics of the present invention, the space separating the prongs is less pronounced on the side of the applicator end fitting which carries the movable part than on the opposite side; the movable part, and the wall of the fixed part which is situated on the opposite side to that carrying said movable part and constituting the bottom of the cavity, comprise notches situated respectively in the extensions of the corresponding edges of the prongs, each notch being V-shaped, the tip of the V opening out in a circular opening.

In a particular embodiment of the present invention, the end fitting comprises a perforator disposed at the end of the applicator end fitting remote from the prongs, the said end fitting being connected to a container formed by two superposed elements, separated by an aluminium foil which can be torn by the perforator, the cross-section of the upper element allowing the perforator to pass into the said element substantially along its axis when the end fitting is fixed on the upper part of the element.

BRIEF DESCRIPTION OF THE DRAWINGS

To render the present invention more readily understood two embodiments, represented in the attached drawings, will be described below by way of purely illustrative and non-restrictive examples.

In these drawings.

DESCRIPTION OF THE PREFERRED EMBODIMENT

Figure 3:
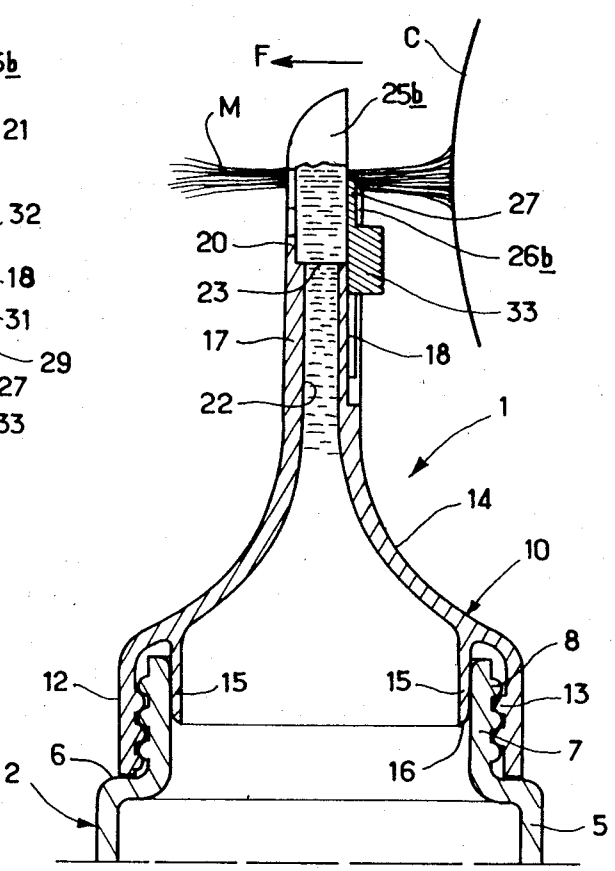
FIG. 3 is an axial cross-sectional view of the applicator device of FIG. 1, the cross-section being effected in a plane perpendicular to that of the flap.
Figure 2:
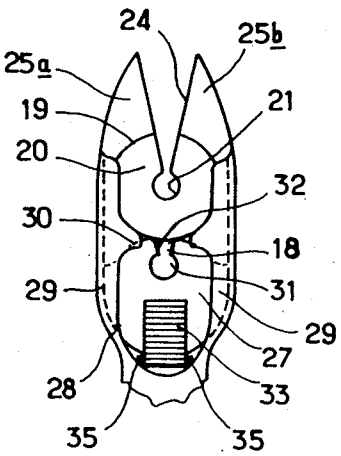
FIG. 2 is a view similar to FIG. 1, only showing the dispenser head, the flap being in its retracted position.
Figure 1:
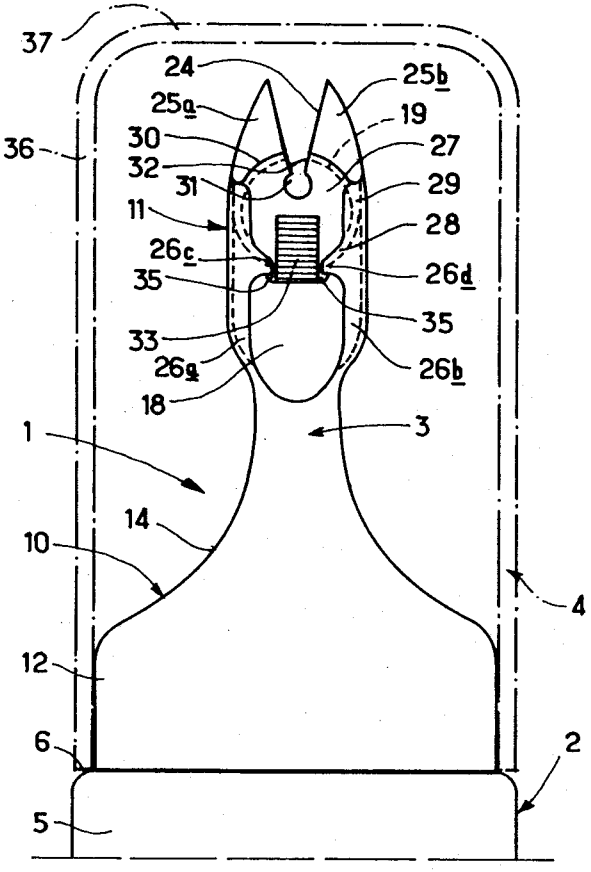
FIG. 1 is an elevational view of an applicator device in accordance with a first embodiment of the invention, only the upper part of the reservoir having been represented, the flap of the dispenser head having been shown in a front view in its extended position.

Referring now to FIGS. 1 to 3, it will be seen that 1 designates generally a device for applying a dyeing product to a head of hair in accordance with the tress by tress technique producing a sweeping effect.

The device 1 comprises a flexible bottle 2, a detachable dispenser end fitting 3, and a protective cap 4 which is also detachable.

The bottle 2, made for instance of polyvinyl chloride, has an elongate cylindrical barrel 5 whose external wall has near its free edge a radially inward step 6 which forms a neck 7 carrying an external thread 8.

The dispenser end fitting 3, made for instance of polypropylene, consists of a mounting 10 for detachably mounting it on the bottle 2, and also an applicator head 11.

The base 10 comprises a cylindrical wall 12 having an internal thread 13, complementary to the thread 8 of neck 7. The wall 12 is joined to a wall 14 which tapers along a direction away from the wall 12, to flare slightly at its point of transition with the dispenser head 11. The wall 14 has internally thereof a skirt 15 which is coaxial with the wall 12 and which, in the assembled position of the end fitting 3, bears against the internal wall of the neck 7, so as to ensure the stoppering seal. The free edge 16 of the skirt 15 is chamfered to facilitate insertion of the skirt 15 into the bottle 2.

The dispenser head 11 has an overall elongate shape and forms an extension of the wall 14. The dispenser head 11 comprises two opposite faces 17 and 18 disposed substantially parallel to each other, and symmetrically with respect to a plane passing through the axis of the end fitting 3. The faces 17 and 18 have similar shapes, that is to say they are in the form of rectangles with rounded ends, the rectilinear edges being parallel to the axis of the end fitting 3.

The face 18 includes a cylindrical cavity 19 having its axis perpendicular to the said face. This cavity 19 is situated in the upper half of the head 11 and is fairly deep. It is formed by a circular floor 20 of slight thickness, whose external surface is a portion of the face 17. This floor 20 has at its centre a circular opening 21, as may be seen in FIG. 2. The outlet duct 22 (FIG. 3) of the end fitting 3, delimited by the wall 14 and having its axis identical with that of the bottle 2 when the end fitting 3 is assembled on the bottle 2, opens out at 23 (FIG. 3) into the cylindrical wall delimiting the cavity 19. Moreover, in the rounded distal end of the dispenser head 11 is a V-shaped notch 24 whose plane of symmetry is perpendicular to the faces 17 and 18. Thus, two identical prongs 25*a*, 25*b*, whose function will be described below, are formed in the upper portion of the head 11. On the side of the face 17, the V notch 24 opens into the circular opening 21 in the wall 20.

Two identical lateral side wall portions 26*a*, 26*b* are formed on the face 18, by moulding together with the head 11. They are disposed parallel to the face 18. These side wall portions 26*a*, 26*b* are each joined to one edge of the face 18 in the rectilinear zone of this edge and in the rounded zone of transition with the wall 14. The width of one side wall portion 26*a* or 26*b* is such that said side wall portion projects from the wall delimiting the cavity 19. Moreover, each of the side wall portions 26*a*, 26*b* has an extension 26*c*, 26*d* respectively which is situated above the edge zone of cavity 19 on the side of the cavity remote from the prongs 25*a*, 25*b* and which also projects over the cavity 19. Together with the main element constituting the head 11, the side wall portions 26*a*, 26*b* form slides whose function will be indicated below.

The head 11 is, in effect, completed by a movable flap 27 having a lower semi-circular edge 28 extended tangentially by two rectilinear edges 29 joined by an upper end edge 30 having a rounded shape with a concavity opposite to that of the edge 28. The flap 27 has, on its median line, parallel to the edges 29 and near its end edge 30, a circular orifice 31 into which opens a V-shaped notch 32 in the end edge 30. On the end opposite to said notch 32 the flap 27 carries a handling knob 33 projecting on its external face and joined to the edge 28. On both sides of the transition zone are lateral extensions 35 intended to bear against the extensions 26*c*, 26*d* of the respective side wall portions 26*a*, 26*b*, the extended position of the flap 27, as represented in FIG. 1.

It will be seen that the flap 27 is slidable in the slides formed by the side wall portions 26*a*, 26*b* and the wall 18 of the head 11. In the extended position of the flap 27, the bottom of the notch 32 is situated beyond the bottom of the notch 24 opening out into the orifice 21, so that the space separating the two prongs 25*a* and 25*b* is deeper on the side of the applicator end fitting further from the observer in FIG. 1 than on the side (defined by the flap 27) nearer to the observer.

The device 1 is completed by a protective cap 4 comprising a lateral cylindrical skirt 36 joined to a top 37.

During use, the hairdresser mixes the colorants directly in the bottle 2. Then the end fitting 3, provided with its protective cap 4, is screwed in position and the unit shaken to obtain a suitable homogenisation of the products. The cap 4 is then removed and the unit is ready for use. By pressing on the flexible wall 5 of the bottle 2, the product is fed into the receptacle defined by the flap 27 in its extended position, the floor 20 and the lateral cylindrical wall delimiting the cavity 19. The product flows into this receptacle via the orifice 23. One tress M from the head of hair to be treated is then separated, and is introduced between the two prongs 25*a*, 25*b* of the dispenser head 11, preferably at the hair root, that is to say near the skin of the scalp C represented in FIG. 3. By a movement extending from the root as far as the tip of the tress M, the operator then impregnates the tress with the product.

After use, the flap 27 is manipulated to assume the position shown in FIG. 2 which allows proper cleaning of the said head 11 and of its cavity 19.

Figure 4:
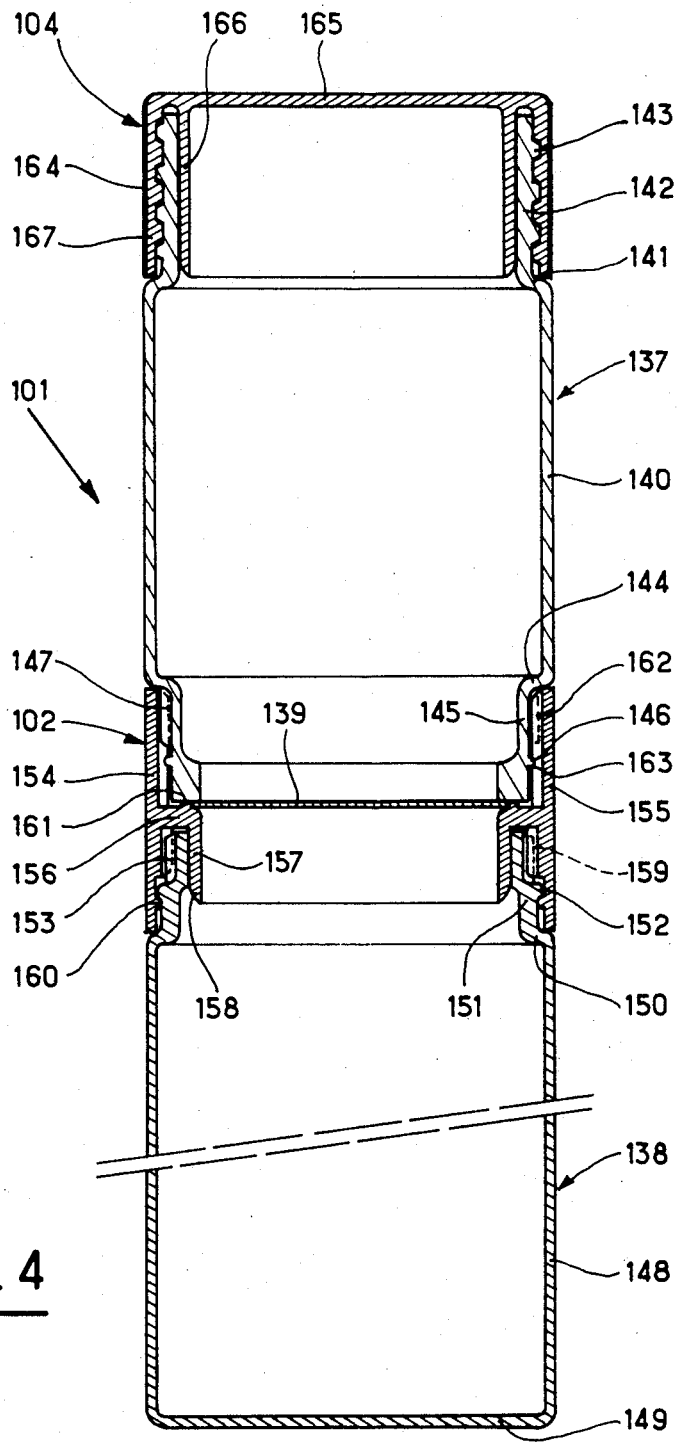
FIG. 4 is an axial cross-sectional view of the reservoir of an applicator device in accordance with a second embodiment of the invention, in its closed position before use.
Figure 5:
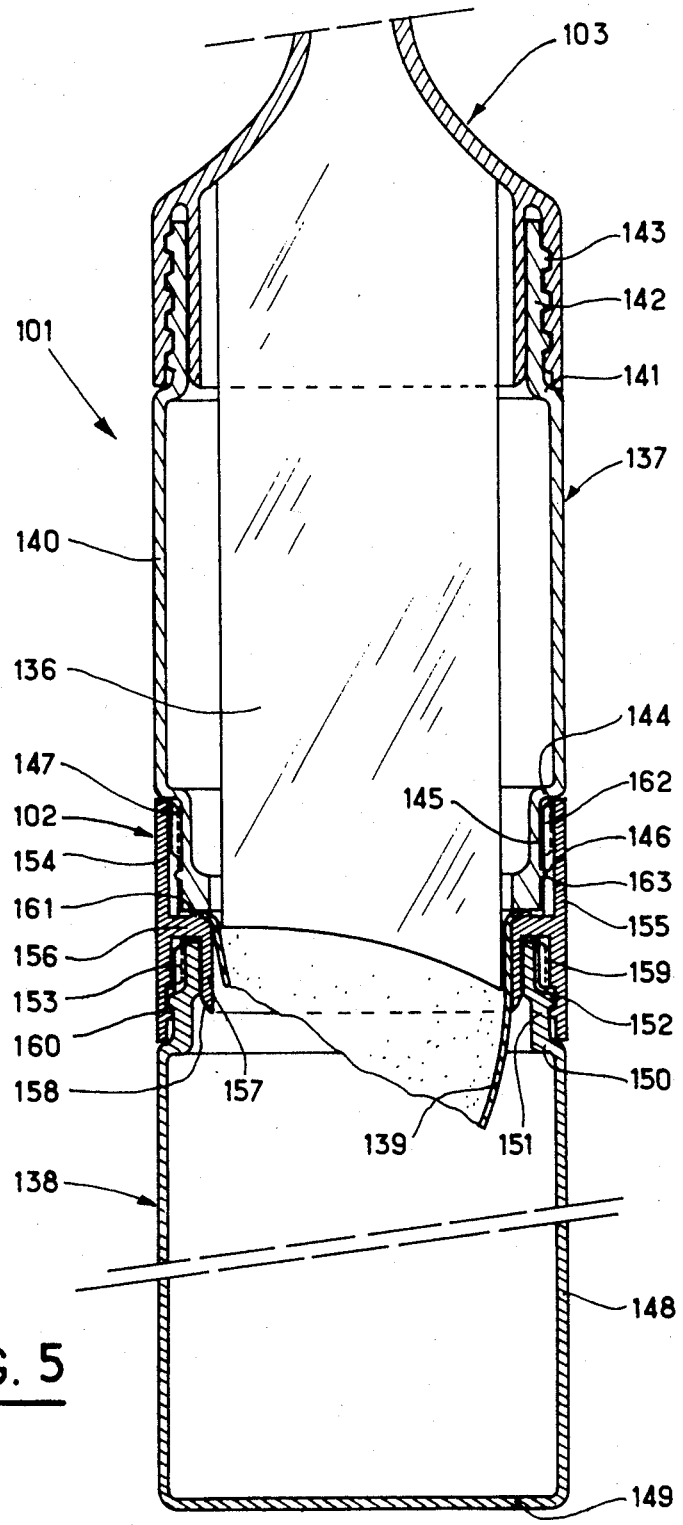
FIG. 5 is an axial cross-sectional view of the applicator device of FIG. 4, when the stoppering cap has been replaced by the dispenser end fitting ready for use.

If reference is now made to FIGS. 4 and 5, it will be seen that 101 designates, as a whole, a device constituting a variant of the device 1 of FIGS. 1 to 3. The device 101 comprises in the same way, a bottle 102, an end fitting 103 and a protective cap 104. However, the cap is intended to be mounted on the opening of the bottle 102 and not on the end fitting 103.

The end fitting 103 only differs from the end fitting 3 to the extent that it carries internally in its lower portion a perforator 136 whose function will be indicated below; otherwise its structure is identical with that of the end fitting 3.

The bottle 102 is formed by two stacked elements 137 and 138. The lower element 138 made of polyethylene and the upper element 137 made of polyvinyl chloride are joined by an intermediate connector sleeve 154.

The element 137 comprises a cylindrical wall 140 having a shoulder 141 near its upper edge. Beyond this shoulder 141, the wall 140 has a smaller diameter, this portion with the smaller diameter forming a neck 142 carrying an external thread 143. Similarly, near its edge at the opposite end, the wall 140 has an annular radially inward step 144 to a smaller diameter end portion 145 having an external annular retaining ring 146. Between the annular retaining ring 146 and the step 144, the wall 145 has external anti-rotation catches 147 parallel to the axis of the upper element 137. Moreover, near this end, the wall 145 is of increasing thickness, the actual end being closed by an aluminium foil 139 which is sealed to the edge of the wall 145.

The lower element 138 consists of a lateral wall 148 joined to a bottom 149. Near its free edge, the wall 148 has two successive radially inward steps 150, 151, the step 151 comprising an external bead 152. Similarly, the cylindrical end wall carries external anti-rotation catches 153 parallel to the axis of the lower element 138.

The connector sleeve 154 comprises a tubular wall 155 to which there is joined internally a flange 156 folded at right angles to constitute a skirt 157 to ensure a stoppering seal of the lower element 138. The free edge 158 of the skirt 157 is chamfered to facilitate the positioning of the connector sleeve 154. Opposite the skirt 157, the inwardly facing surface of the wall 155 comprises anti-rotation catches 159, intended to cooperate with the anti-rotation catches 153, and also has an internal bead3 160 intended to be snap-fitted in position below the bead 152 in the assembled position of the bottle.

On its opposite side remote from the skirt 157, the flange 156 carries a bead 161. The tubular wall 155 carries internally, above the flange 156, anti-rotation catches 162, intended to cooperate with the anti-rotation catches 147. These anti-rotation catches 162 comprise a radically inner annular groove 163 intended to cooperate with the bead 146 of the element 137.

The protective cap 104 is formed by a cylindrical peripheral wall 164 joined to a top 165 which internally carries a skirt 166 coaxially with the wall 164. This skirt 166 ensures the stoppering seal, whereas the skirt 164 ensures closure by screwing on the element 137, with a thread 167 of the skirt 164 cooperating with the thread 143 of the neck 142.

The assembly of the unit 101 is effected as follows: the aluminium foil 139 is sealed to the lower portion of the element 137. Then the connector sleeve 154 of the retaining ring 146 comes to be positioned in the groove 163 by catch engagement.

The upper element 137 is filled with the desired product and then the cap 104 is applied.

Having filled the lower element 138 with a product intended to be mixed with that contained in the upper element 137 only at the time of use, the lower element 138 then becomes stoppered by the unit 137–154 which has just been formed, the bead 160 coming to be positioned by snap-engagement below the bead 152.

For use, the cap 104 is unscrewed and is replaced by the end fitting 103 which, on completion of the screwing action, perforates the aluminium foil 139 by its perforator 136; the two products stored each in one of the elements 137, 138 can then be mixed and applied in the same way as indicated for the embodiment of FIGS. 1 to 3.

It shall be duly understood that the embodiments described above are in no way restrictive and may give rise to any desirable modifications without thereby departing from the scope of the invention.

I claim:

1. A device for use in applying to a head of hair, in tress by tress manner, a treatment product with a consistency ranging from liquid to pasty, said device comprising:

(a) a reservoir having an outlet opening for the treatment product to be applied; and (b) an applicator end fitting having means for mounting on said outlet opening of said reservoir; wherein said applicator end fitting comprises:

(i) outlet orifice means for dispensing the treatment product;

(ii) at least one fork at the free end of the applicator end fitting, said at least one fork having two prongs with a space between them at their base, and said prongs being able to be guided from end of a hair tress to the other when the tress is placed between said two prongs of said fork, said outlet orifice means being located adjacent said base of said prongs whereby when the treatment product is provided at said outlet orifice means, and the hair tress is placed between said prongs, the treatment product will be applied over the tress; and (iii) storage receptacle means for the treatment product, said space separating the two prongs at their base opening directly into said storage receptacle means for the product, and said storage receptacle means being in communication with the outlet orifice means for the treatment product;

said applicator and fitting comprising a first part and a second part mounted for movement relative thereto; said storage receptacle means being delimited by (a) means defining a cavity in said first part of said applicator end fitting and (b) said second part of said applicator end fitting; and said device including means movably mounting said second part relative to said first part to enable said second part to occupy a first end position in which said second part defines a portion of said storage receptacle means for supplying the treatment product for applying the produce over a hair tress and a second end position, remote from said prongs, wherein said storage receptacle means opens laterally immediately below said prongs in a plane parallel to the median plane containing the prongs thereby leaving free access to said cavity means when in said second end position.

2. A device according to claim 1, wherein said second part of the applicator end fitting is mounted for sliding displacement.

3. A device according to claim 2, wherein said second part of the applicator end fitting is mounted for displacement in a direction parallel to the longitudinal median line of said space separating the two prongs.

4. A device according to claim 2, wherein said second part of the applicator end fitting is a flap mounted for retraction into the first part of the applicator end fitting.

5. A device according to claim 3, wherein said second part of the applicator end fitting is a flap mounted for retraction into the first part of the applicator end fitting; and wherein the applicator end fitting comprises, in a plane near that of the access into the cavity means and on the side of the cavity means which is remote from the prongs, a substantially flat lateral wall carrying two side wall portions disposed in a plane parallel to the said wall to form therewith slides which are directed substantially parallel to the longitudinal median line of said space separating the prongs, said side wall portions allowing the sliding of the flap to be guided; and including an outwardly projecting handling knob on said flaps.

6. A device according to claim 2, wherein said first and second part of the applicator end fitting comprise complementary first and second means, respectively, for limiting the travel of the second part in either of two directions of movement.

7. A device according to claim 5, wherein said first and second parts of the applicator end fitting comprise complementary first and second means, respectively, for limiting the travel of the second part in either of two directions of movement; and wherein said first travel limiting means carried by the first part of the applicator end fitting comprise (i) the ends of said slide-defining side wall portions curving towards each other on the side remote from the prongs and also (ii) the portions of said side wall portions which approach each other in the region near the lateral opening of the cavity means and constitute stops for engaging said second travel limiting means carried by the movable second part of the applicator end fitting.

8. A device according to claim 1, wherein said space separating the prongs is shallower on the side of the applicator end fitting where said movable second part is located than on the opposite side of the applicator end fitting.

9. A device according to claim 1, wherein said second part of the applicator end fitting and the wall of the first part on the side remote from said movable second part and which forms the floor of the cavity comprise respective notches situated in the extension of the corresponding edges of the prongs.

10. A device according to claim 9, wherein each notch is V-shaped, and wherein the V has a tip which opens in a circular opening.

11. A device according to claim 1, wherein the applicator end fitting comprises perforator means disposed on the side of the end fitting which is remote from the prongs; wherein said reservoir to which said applicator end fitting is connected is constituted by superposed first and second elements separated by an aluminium foil which can be torn by said perforator means; and wherein the cross-section of said first element allows the perforator means to pass into the said first element substantially along its axis during mounting of the applicator end fitting on the upper portion of said first element.

* * * * *